US009751122B2

(12) United States Patent
Carruthers

(10) Patent No.: US 9,751,122 B2
(45) Date of Patent: Sep. 5, 2017

(54) TIE BAR TENSIONING SYSTEM

(71) Applicant: AddisonMckee Inc., Lebanon, OH (US)

(72) Inventor: Andrew Ian Carruthers, Milnthorpe (GB)

(73) Assignee: ADDISONMCKEE INC., Lebanon, OH (US)

( * ) Notice: Subject to any disclaimer, the term of this patent is extended or adjusted under 35 U.S.C. 154(b) by 575 days.

(21) Appl. No.: 14/448,246

(22) Filed: Jul. 31, 2014

(65) Prior Publication Data

US 2015/0033819 A1 Feb. 5, 2015

Related U.S. Application Data

(60) Provisional application No. 61/861,065, filed on Aug. 1, 2013.

(51) Int. Cl.

| | |
|---|---|
| ***B21D 7/06*** | (2006.01) |
| ***B21D 7/04*** | (2006.01) |
| ***B21J 9/18*** | (2006.01) |
| ***B21D 7/024*** | (2006.01) |
| ***B21D 7/16*** | (2006.01) |
| ***B21D 7/022*** | (2006.01) |

(52) U.S. Cl.

CPC ..... *B21D 7/06* (2013.01); *B21D 7/022* (2013.01); *B21D 7/024* (2013.01); *B21D 7/04* (2013.01); *B21D 7/16* (2013.01); *B21J 9/18* (2013.01)

(58) Field of Classification Search

CPC ..... B21D 7/06; B21D 7/022; B21D 7/024; B21D 7/16; B21D 7/04; B21J 9/18

USPC ..... 72/149, 159, 453.02

See application file for complete search history.

(56) References Cited

U.S. PATENT DOCUMENTS

| | | | | |
|---|---|---|---|---|
| 1,767,362 A * | 6/1930 | Heer | ..... | B21D 7/022 72/380 |
| 2,974,706 A * | 3/1961 | De Witt | ..... | B21D 9/073 72/150 |
| 7,024,903 B2 | 4/2006 | Schmauder | | |

(Continued)

FOREIGN PATENT DOCUMENTS

| | | |
|---|---|---|
| KR | 10-0299766 | 9/2001 |
| KR | 10-2006-0086297 | 7/2006 |

*Primary Examiner* — David B Jones

(74) *Attorney, Agent, or Firm* — Welsh Flaxman & Gitler LLC

(57) ABSTRACT

A tie bar tensioning system that allows a bending machine operator to removably couple an upper end of a bend die post of the bending machine to a base of the bending machine via a tie bar, and to lock the tie bar in a tensioned position. The tensioning system includes a stationary member and a rotatable member, each with aligned tie bar passages for receiving the one end of the tie bar. Both the stationary member and the rotatable member include respective engagement surfaces, with the rotatable member engagement surface being rotatable relative to the stationary member engagement surface between a released position and a tensioned position whereat the rotatable member is selectively lockable. The rotation of the rotatable member with the rotatable member engagement surface in engagement with the stationary engagement surface longitudinally displacing the rotatable member relative to the stationary member.

25 Claims, 13 Drawing Sheets

(56) References Cited

U.S. PATENT DOCUMENTS

| | | | | |
|---|---|---|---|---|
| 7,299,671 | B2 * | 11/2007 | Caporusso | B21D 7/024 72/149 |
| 7,360,385 | B1 | 4/2008 | Wohlenhaus | |
| 2015/0033819 | A1 * | 2/2015 | Carruthers | B21D 7/024 72/458 |

* cited by examiner

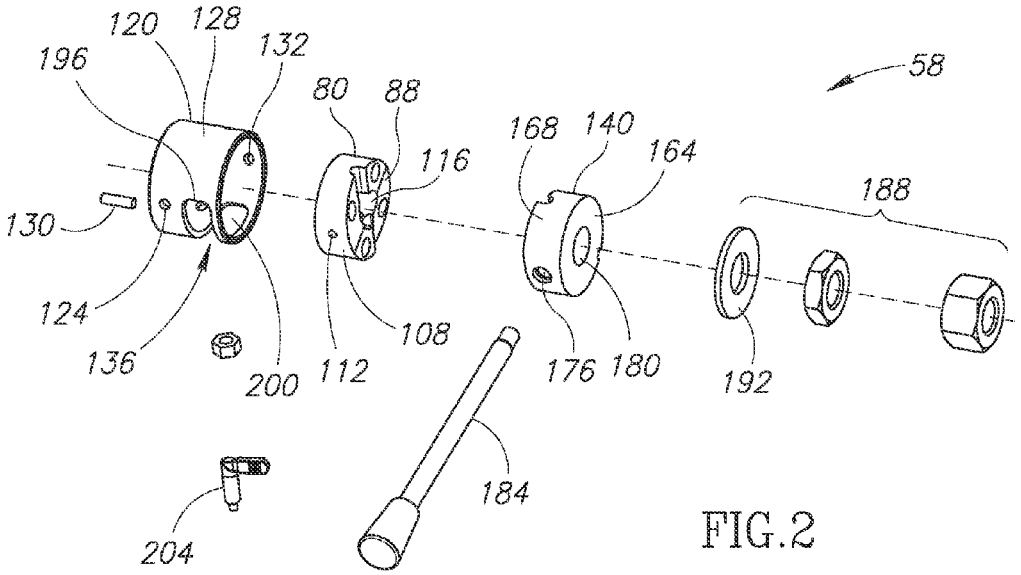
FIG.2
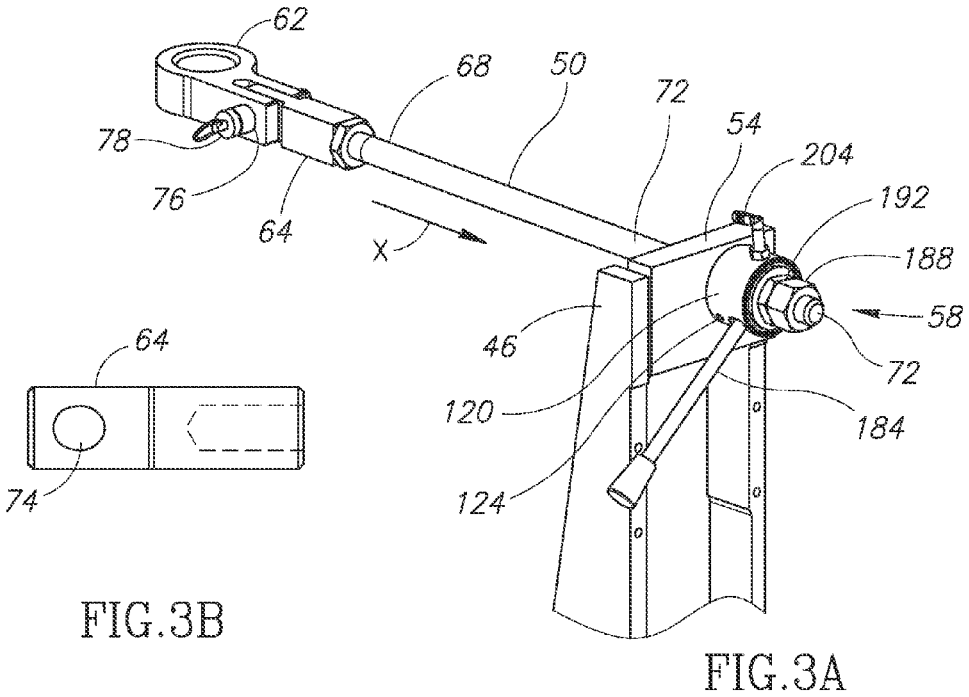
FIG.3B
FIG.3A

TIE BAR TENSIONING SYSTEM

CROSS REFERENCE TO RELATED APPLICATIONS

This application claims the benefit of U.S. Provisional Patent Application No. 61/861,065, entitled Machine Tooling Change System, filed Aug. 1, 2013, the entire disclosure of which is hereby incorporated by reference.

BACKGROUND OF THE INVENTION

Field of the Invention

The present invention is directed generally to systems and methods for improving a tube bending machine, and to systems and methods for efficiently changing tooling for such machines.

Description of the Related Art

Pipe (or tube) bending is the generally-used term for metal forming processes used to permanently form pipes or tubing. The resulting pipes or tubes may be used in a variety of applications, including but not limited to, automotive exhaust systems and household water systems. There are multiple types of procedures for bending tubes, including form-bound procedures. Form-bound bending procedures like "press bending" or "rotary draw bending" are used to form the work piece into the shape of a die. Straight tube stock can be formed using a bending machine to create a variety of single or multiple bends and to shape the piece into the desired form. These processes can be used to form complex shapes out of different types of ductile metal tubing. Generally, round stock tubes are used in tube bending. However, square and rectangular tubes and pipes may also be bent to meet job specifications. Other factors involved in the tube bending process are the wall thickness of the tubes and the tooling and lubricants needed by the tubes.

To bend a tube in a rotary-draw bender, it is first positioned inside the bender. It is then locked in place by closing of the clamp die onto the bend die. With the tube in place, the bend die and clamp die then rotate around as one piece, bending the tube around the bend die, with the pressure die maintaining pressure against the wiper, and moving along in the axial direction at a prescribed percent boost. The rotation is continued until a desired tube bend angle is reached. To control the axial tube motion, the pressure die applies axial force to the tube either through friction (between pressure die and tube) or through an optional boost block, which pushes against the back of the tube during bending. A boost clamp may also be used to compliment the friction and boost block. The boost clamp is a mechanical clamping device that grips the tube to the pressure die when friction is not enough or the end of the tube cannot be accessed.

The role of the pressure die is two-fold. First, it must exert sufficient clamping pressure by pushing the tube against the wiper die (inclined at a small rake angle) to prevent wrinkling on the inside bend of the tube, and secondly it must control the axial movement of the back of the tube feeding into the bend. In many applications, tube bending requires precise alignment between a bend die, follower die, clamp die, and wiper die.

To change the various dies for different be sized tubing, general practice has been to individually remove each of the dies and reassemble a new die set onto a bending machine, which is time-consuming and results in considerable downtime.

BRIEF DESCRIPTION OF THE SEVERAL VIEWS OF THE DRAWING(S)

FIG. 2 is an exploded view of components of the first tie bar tensioning systems of FIG. 1.

FIG. 3A is a perspective view of the tie bar of the first tie bar tensioning system of FIG. 2.

FIG. 3B is an enlarged elevational view of a tie bar fitting of the first tie bar tensioning system of FIG. 3 show removed from the tie bar.

DETAILED DESCRIPTION OF THE INVENTION

This detailed description, with reference to the accompanying drawings, discusses illustrative embodiments of an inventive concept, specifically a tie bar tensioning system for use in a bending machine, and is provided to give persons having ordinary skill in the relevant art a full, clear, concise, and exact description of this inventive concept, and to enable such persons to appreciate and understand how to make and use embodiments of the conceptual tie bar tensioning system, including not only the explicitly described illustrative embodiments but also, by inference and implication, all other embodiments that fall within the scope of the inventive concept, despite those embodiments not being explicitly described below. However, nothing in this detailed description should be interpreted to define or otherwise limit the scope of the inventive concept itself; that is the sole function of the claims which follow this description.

In operation, when a bending machine is operated, a tie bar may advantageously be used to prevent damage to the machine by securely holding the top of the bend die post against bending movement. The tie bar may also be used to control the quality of bending by restricting and containing strain produced by the tube being bent and the tooling. It is important that all the components of the tie bar system be rigid with respect to one another during operation of the bending machine, such that the components of the system move as a unitary object. However, the tie bar can interfere with efficient changing of the tooling on the bending machine. Therefore, the tie bar should also be movable relative to the bending machine. In a conventional tie bar system, a user has to use one or more tools such as wrenches to decouple the tie bar from the bending tool so that the bending tool can be removed from the bending machine. For some larger bending machines, these parts can be very heavy and difficult to move.

Figure 1:
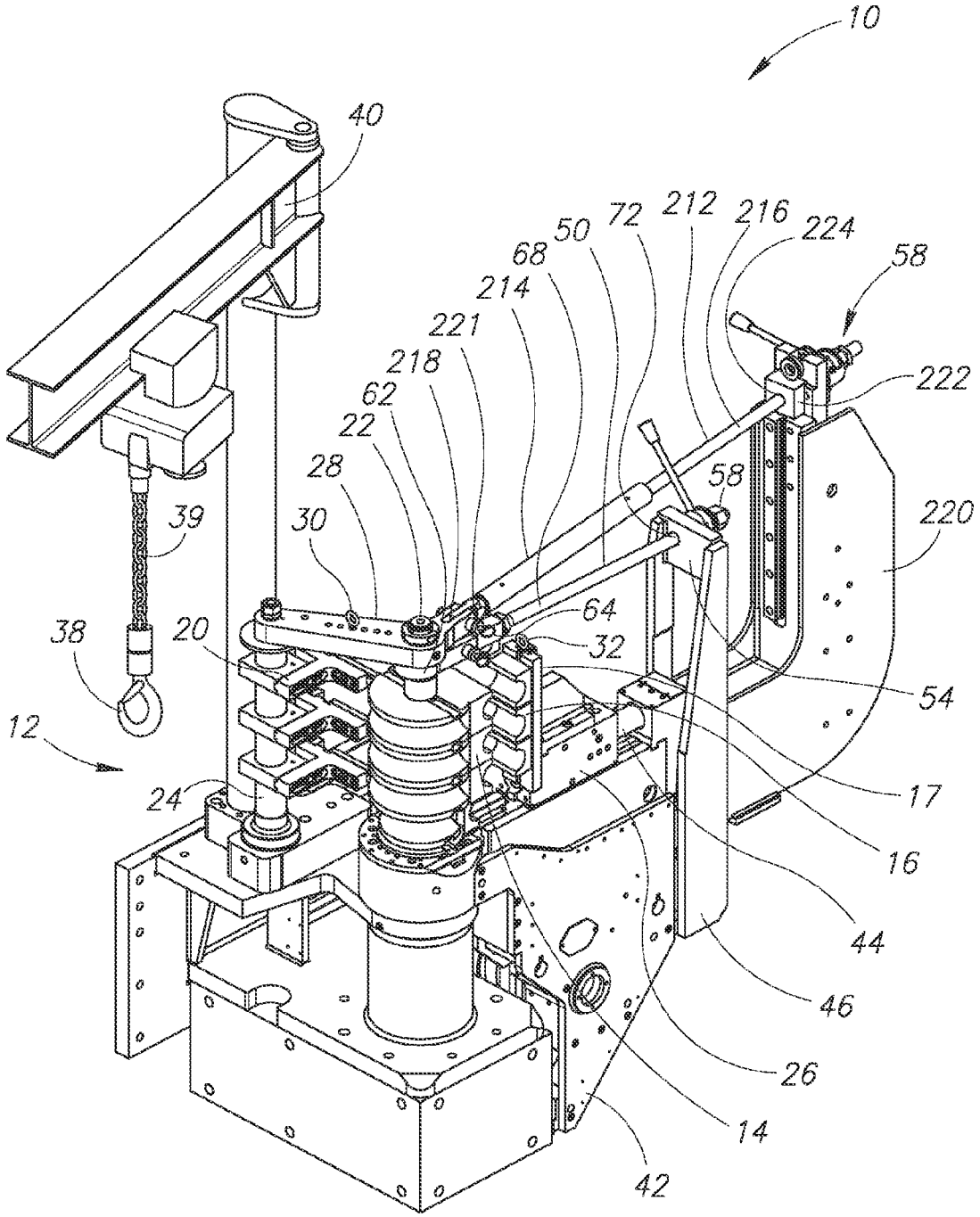
FIG. 1 is a front left perspective view of a rotary draw bending machine configured with multiple tie bars and first and second accompanying tie bar tensioning systems embodying aspects of the present invention.
Figure 6:
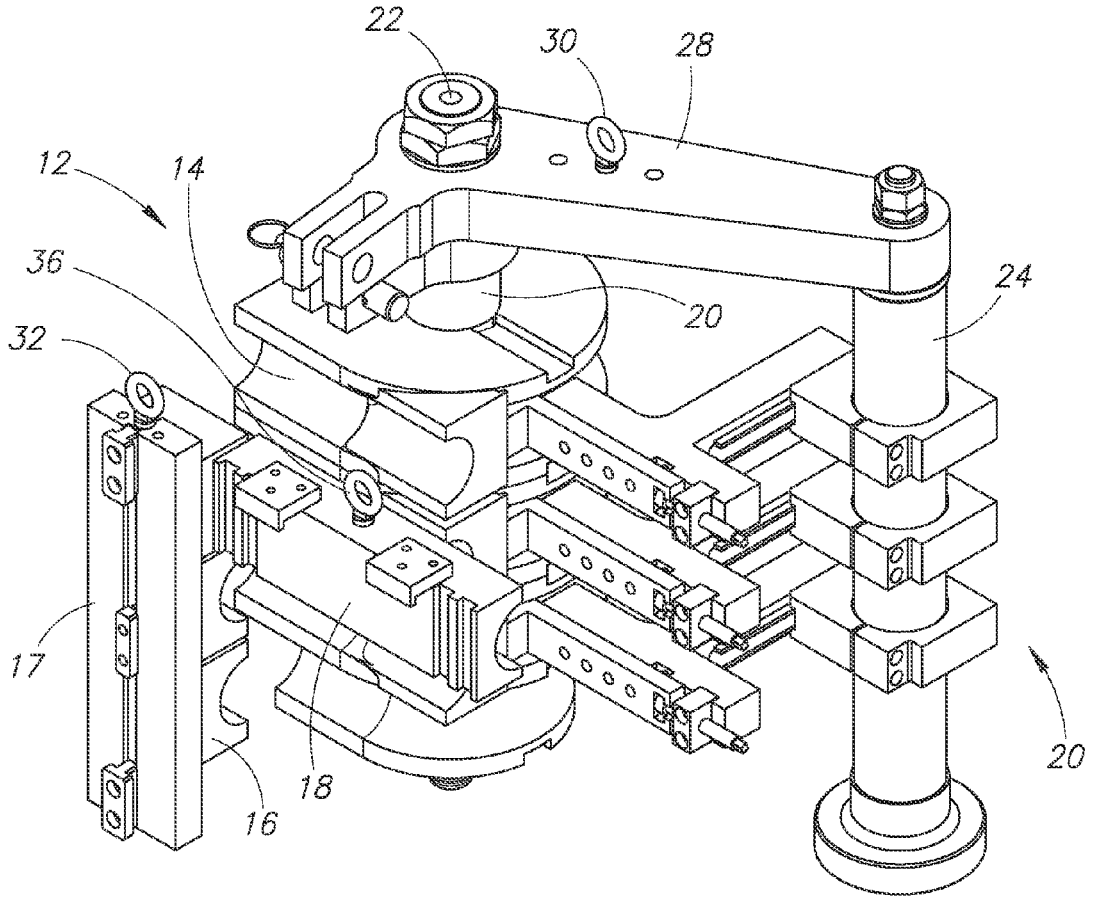
FIG. 6 is a substantially rear perspective view of a bending die set and bracket of the rotary draw bending machine of FIG. 1.
Figure 7:
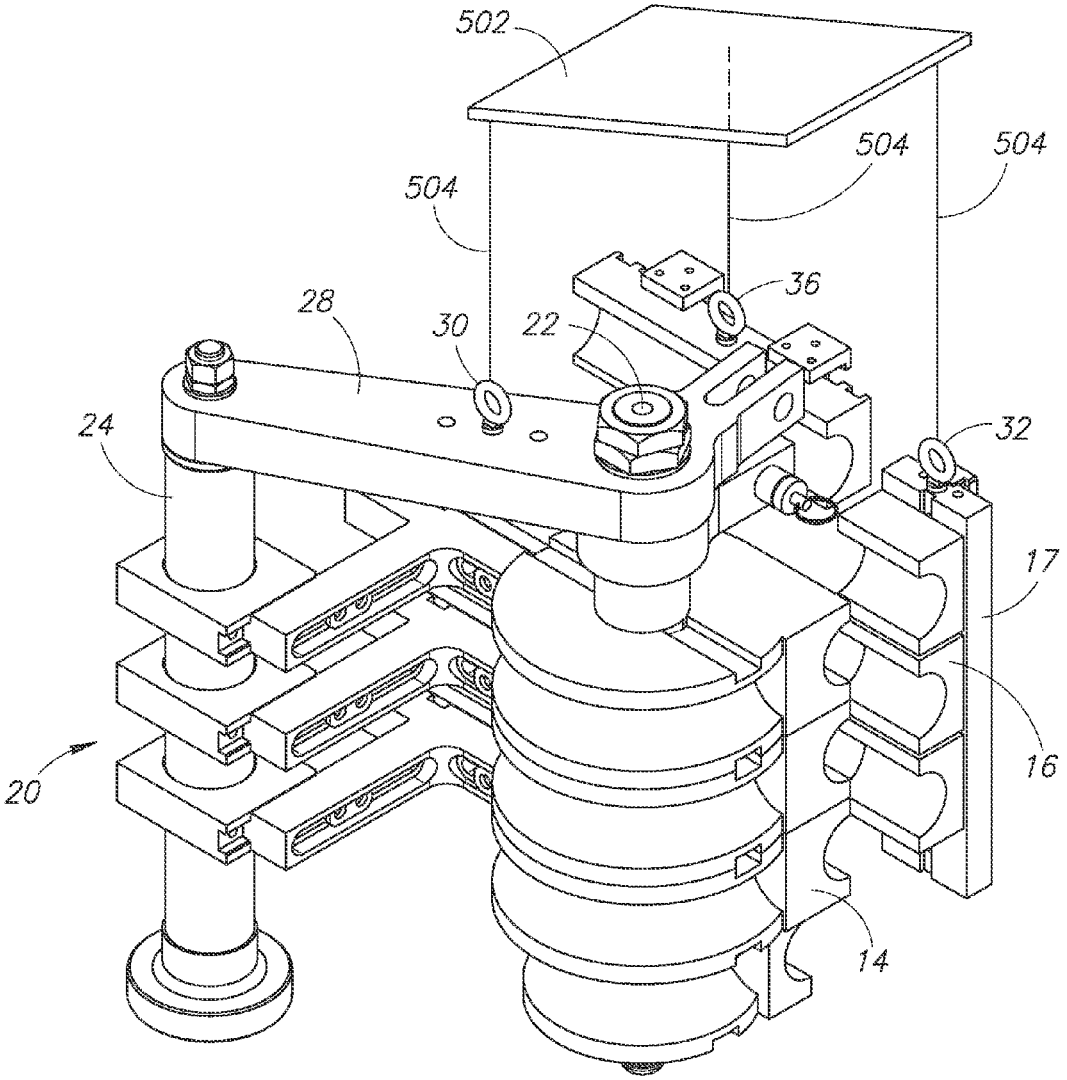
FIG. 7 is a substantially front perspective view of the bending die set and bracket of FIG. 6.
Figure 8:
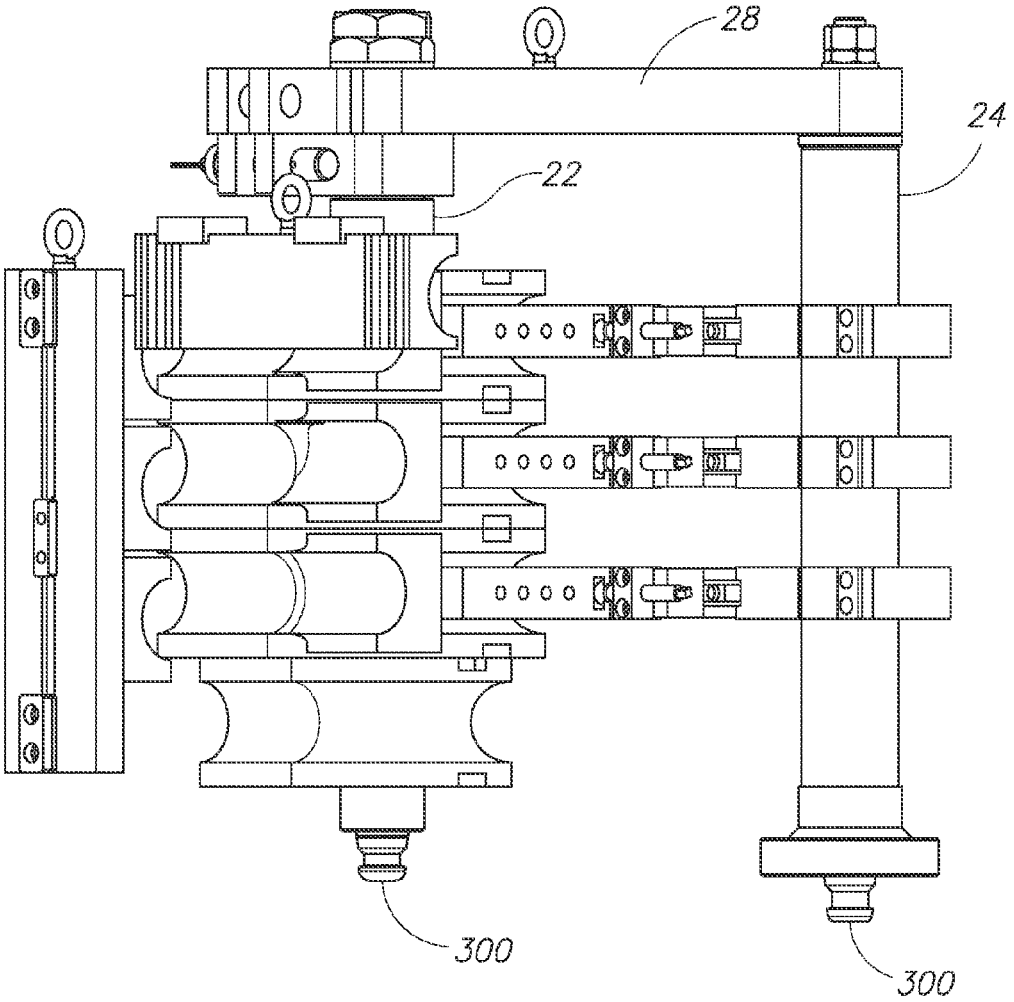
FIG. 8 is a substantially rear elevational view of the bending die set of FIG. 6.
Figure 9:
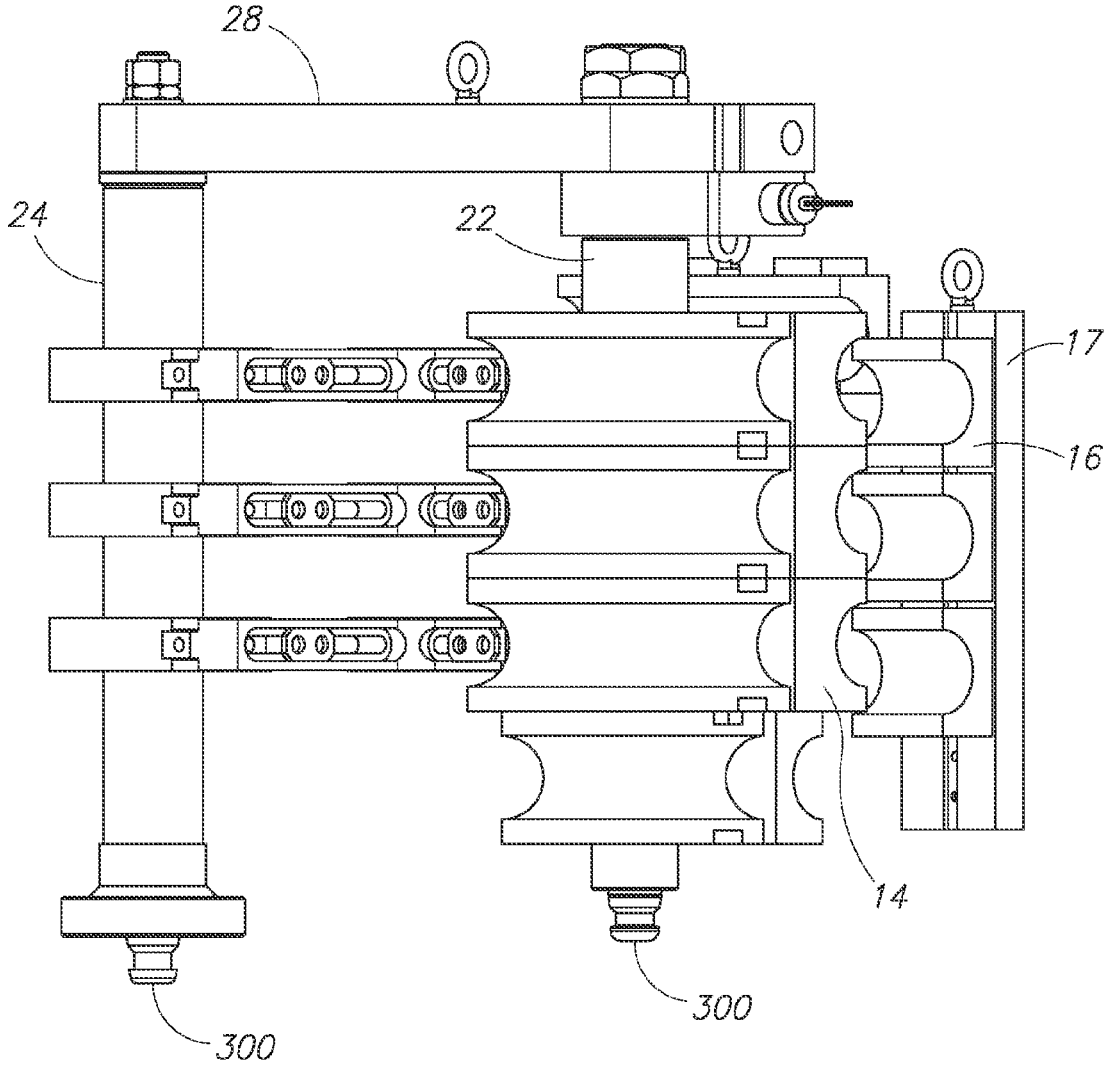
FIG. 9 is a substantially front elevational view of the bending die set of FIG. 6.
Figure 10:
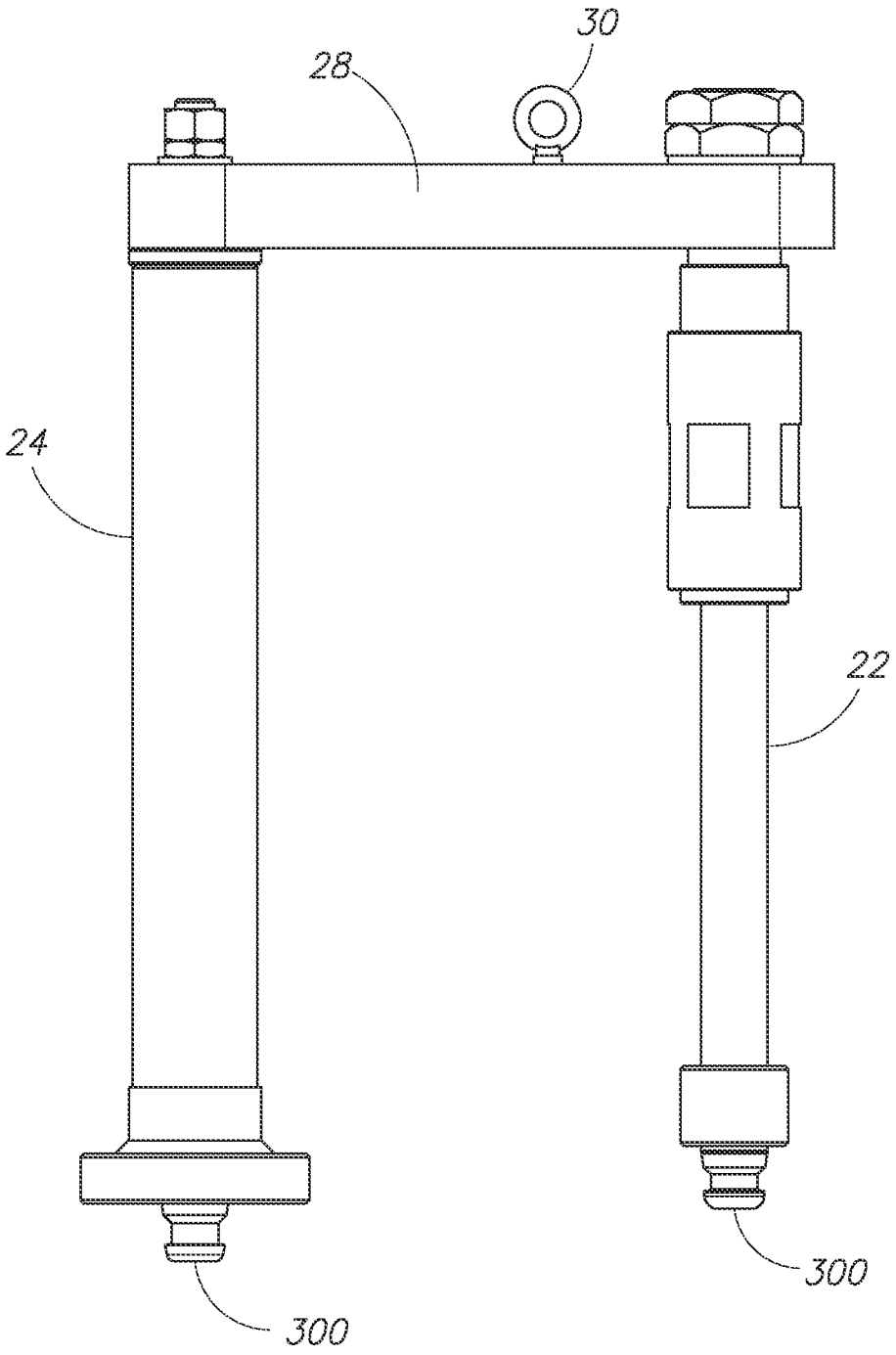
FIG. 10 is an elevational view of a bend die post and a wiper die post of the bending die set of FIG. 6, each configured with a clamping pin.

FIG. 1 illustrates a rotary draw bending machine 10 configured with two non-limiting embodiments of the conceptual tie bar tensioning system, described below. A multi-component die set 12, illustrated in more detail in FIGS. 6-9, includes a bend die stack 14, a clamp die stack 16, a pressure or follower die 18 (see FIGS. 6-9), and a wiper die stack 20. The bend die stack 14 is supported by a bend die post 22 and the wiper die stack 20 is supported by a wiper die post 24. The clamp die stack 16 and a clamp die bolster 17 are supported by a clamp die holder 26. A lift arm or plate 28 extends between and is coupled to upper end portions of both the bend die post 22 and the wiper die post 24 (best seen FIG. 10). An eyebolt 30 extends upwardly from the lift plate 28. A second eyebolt 32 extends upwardly from the clamp die bolster 17 for the clamp die stack 16. A third eyebolt 36 extends upwardly from the follower die 18 (FIG. 6). The eyebolts 30, 32 and 36 are configured to facilitate lifting of the removable die components of the die set 12, for example, by a hook 38 and chain 39 coupled to a crane 40.

It is noted that while for clarity the drawings show a single follower die 18, the die set 12 may include a plurality of these vertically stacked and supported by a holder to which an eyebolt could be attached. In some case there may be a single part follower die with multiple grooves.

The clamp die stack 16 is supported by a pivot arm 42. In operation, a servo-driven lead screw 44, which is also supported by the pivot arm 42, presses the clamp die stack 16 against the pipe being bent. A support frame 46 extends upwardly from the pivot arm 42 to brace the rear side of the servo-driven lead screw 44. As is described above, to increase the structural stability of the bending machine, a tie bar 50 is coupled under tension between the top of the bend die post 22 and a tie bar mounting plate 54 located at the upper end of the support frame 46.

A first, non-limiting embodiment of the conceptual tie bar tensioning system, indicated generally by reference numeral 58, is used to selectively apply and release tension to the tie bar 50, as is explained in more detail below, and is mounted to an outward surface of the tie bar mounting plate 54. As is also shown in FIG. 3, the tie bar 50 is removably joined to the upper end of the bend die post 22 by a machine tooling bracket 62 removably attached to a tie bar fitting 64 attached to an inward end 68 of the tie bar 50. An outward end 72 of the tie bar 50 passes through tie bar mounting plate 54 and the tie bar tensioning system 58. The tie bar fitting 64 has a transverse aperture 74 (FIG. 3B). A pair of opposing apertures 76 are formed in the two arms of the machine tooling bracket 62 and in axial alignment with the aperture 74 in the tie bar fitting 64 when the tie bar fitting is positioned between the two arms of the machine tooling bracket. When so positioned and the tie bar tensioning system 58 is not under tension, as is explained below, a pull pin 78 may be placed through and/or removed from the apertures 74 and 76, thereby respectively coupling and/or decoupling the inward end 68 of the tie bar to the upper end of the bend die post 22. As shown in FIG. 3A, the aperture 74 in the tie bar fitting 64 may be slightly elongated to facilitate easier removal and insertion of the pull pin 78 by hand.

Figure 4:
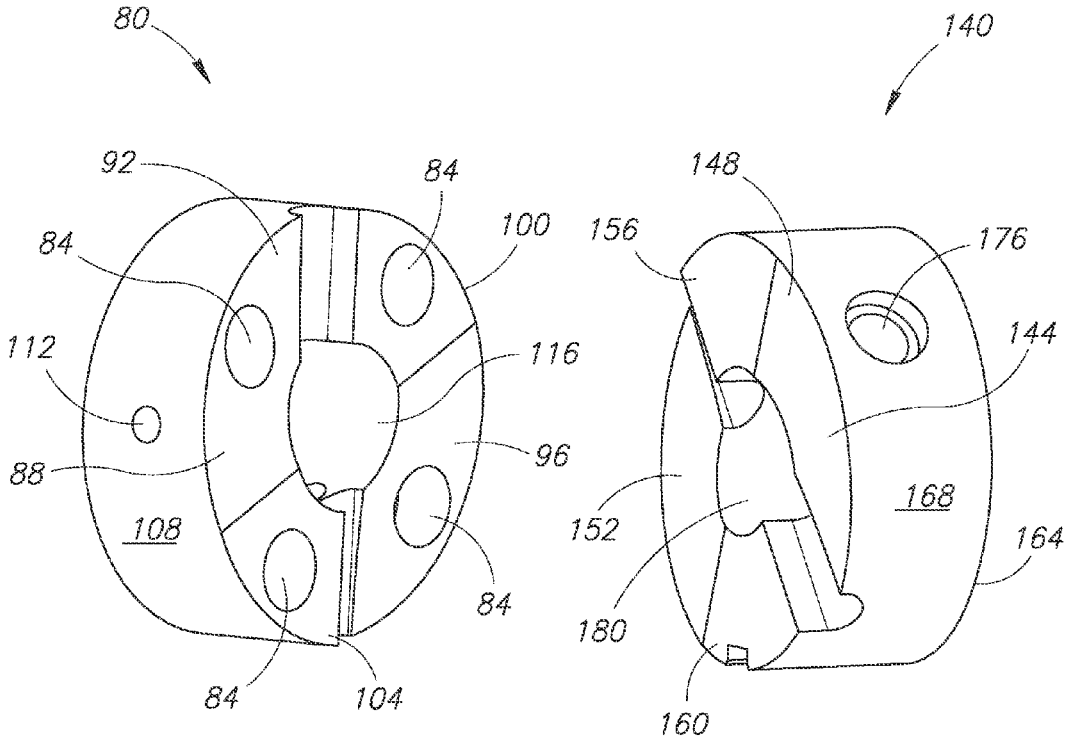
FIG. 4 is an enlarged exploded view of components of the first tie bar tensioning system of FIG. 2.

FIG. 2 illustrates an exploded view of the components of the tie bar tensioning system 58. As noted above, the outward end 72 of the tie bar 50 passes through an aperture (not shown) in the tie bar mounting plate 54 and then through a longitudinal passageway (with the orientation indicated by the dashed line in FIG. 2) in the tensioning system 58. The tie bar tensioning system 58 includes a cylindrical stationary face cam 80, immovably affixed to the tie bar mounting plate 54 (FIG. 3). For example, as shown in FIG. 4, the stationary face cam 80 may be formed with bolt holes 84 for bolting the stationary face cam 80 to the tie bar mounting plate 54. The stationary face cam 80 has a stationary engagement surface 88 formed with two profiled elements 92 and 96 (sloping cam surfaces) and two flat surfaces 100 and 104 at the top end of the sloping cam surfaces. A sidewall 108 of the stationary face cam 80 is formed with a radial locking pin hole 112. The stationary face cam 80 is also formed with a stationary tie bar central passageway 116, which is aligned with the corresponding aperture in the tie bar mounting plate 54.

A cylindrical collar or sleeve 120 is disposed over and joined to the stationary face cam 80 using a sleeve locking pin hole 124 corresponding to the radial locking pin hole 112 of the stationary face cam sidewall 108. A locking pin 130 is inserted through the sleeve locking pin hole 124 and the radial locking pin hole 112, thereby preventing movement of the sleeve 120 relative to the stationary face cam 80. The sleeve 120 extends outwardly away from the tie bar mounting plate 54 past the engagement surface 88 of the stationary face cam 80, defining an outer portion 128 of the sleeve 120 formed with an outer locking pin hole 132 and a cam lever rotation slot 136.

A rotatable face cam 140 is rotatably disposed in the outer portion 128 of the sleeve 120 and includes an inwardly facing rotatable engagement surface 144 for engaging the stationary engagement surface 88 of the stationary face cam 80. Similar to the stationary engagement surface 88, but in reverse arrangement, the rotatable engagement surface 144 is formed with two profiled elements 148 and 152 (sloping cam surfaces) and two flat surfaces 156 and 160 at the top end of the sloping cam surfaces. Respective pairs of profiled elements 92 and 148 and profiled elements 96 and 152 are positioned opposed to each other, and respective pair of flat surfaces 100 and 156 and the pair of flat surfaces 104 and 160 are positioned opposed to each other the tie bar tensioning system 58 when in a tensioned configuration. Opposite its engagement surface 144, the rotatable face cam 140 has an outwardly facing tensioning surface 164. A rotatable face cam sidewall 168 extends between the rotatable engagement surface 144 and the outwardly facing tensioning surface 164 of the rotatable face cam 140. The rotatable face cam sidewall 168 has a radial locking pin hole (similar to the radial locking pin hole 112 in the stationary face cam 80) and an interiorly threaded radial cam lever port 176. The rotatable face cam 140 is also formed with a rotatable tie bar central passageway 180.

When the rotatable face cam 140 is disposed in the outer portion 128 of the sleeve 120, the rotatable tie bar central passageway 180, the stationary tie bar central passageway 116 of the stationary face cam 80 and the aperture in the tie bar mounting plate 54 are in axial alignment and allow for sliding longitudinal movement of the tie bar 50 therein (e.g., in the axial direction indicated by the arrow "X" in FIG. 3, and in the reverse axial direction). Additionally, the radial cam lever port 176 of the rotatable face cam 140 is in alignment with the cam lever rotation slot 136. A cam lever 184 extends through the cam lever rotation slot 136 of the sleeve 120 and is threadably coupled to the rotatable face cam 140 via the radial cam lever port 176. The rotatable engagement surface 144 of the rotatable face cam 140 and the stationary engagement surface 88 of the stationary face cam 80 engage in the manner described below.

To initially install the tie bar 50 in the configuration shown in FIG. 1, the outward end 72 of the tie bar 50 is passed through the tie bar passageways 116 and 180 of the tie bar tensioning system 58 and the aperture in the tie bar mounting plate 54. The tie bar fitting 64 at the inward end 68 of the tie bar 50 is then coupled to the machine tooling bracket 62 as described above. A lock nut-washer combination 188 may then be installed on a threaded end portion of the outward end 72 of the tie bar 50 which extends past the rotatable face cam 140 and rotated to move inwardly an washer 192 of the lock nut-washer combination 188 is adjacent to the outward facing tensioning surface 164 of the rotatable face cam 140.

Starting from the non-tensioned configuration, movement of the cam lever 184 from one end 196 of the cam lever rotation slot 136 towards an opposite end 200 of the cam lever rotation slot 136 will cause corresponding rotation of the rotatable face cam 140 within the sleeve 120. This rotation will cause the respective pairs of profiled elements 92 and 148, and 96 and 152 of the stationary and rotatable engagement surfaces 88 and 144 to slidably engage and translate the rotational movement of the rotational face cam 140 into outward longitudinal movement of the rotational face cam. This camming action results in the tensioning surface 164 of the rotatable face cam 140 pushing against the washer 192 of the lock nut-washer combo 188 and applying a longitudinally outward force on the lock nut-washer combo 188 and an outward tensioning force on the tie bar 50 for operation of the bending machine 10. Continued rotation of the rotatable face cam 140 will then cause respective flat surfaces 100 and 156 and flat 104 and 160 of the stationary and rotatable engagement surfaces 88 and 144 to rotate into alignment and resulting in the maximum achievable movement of the rotatable face cam outward away from the stationary face cam 80, and applying the maximum tension to the tie bar 50.

When in this position with the respective flat surfaces in engagement, the radial locking pin hole of the rotatable face cam (not shown) is aligned with the sleeve's outer locking pin hole 132 of the outer portion 128 of the sleeve 120. The rotatable face cam 140 may then be locked in place by inserting a tabbed locking pin 204 through the outer locking pin hole 132 and into the radial locking pin hole of the rotatable face cam. When it is desired to remove the tension on the tie bar 50, the tabbed locking pin 204 is removed, and the cam lever 184 is moved from its position toward the end 200 of the cam lever rotation slot 136 to the end 196 of the cam lever rotation slot causing the reverse rotational movement of the rotatable face cam 140 relative to the stationary face cam 80 to return the tie bar tensioning system 58 to the non-tensioned configuration.

Once the tension in the tie bar 50 has been removed, a user can easily manually remove the pull pin 78 from the apertures 76 in the machine tooling bracket 62 and the elongated aperture 74 in the tie bar fitting 64 without requiring a tool. Once the pull pin 78 has been removed, the inward end 68 of the tie bar 50 may be separated and move away from the machine tooling bracket 62, and hence the bend die post 22, by moving the tie bar in the axial "X" direction shown in FIG. 3 and sliding it outward through the aperture in the tie bar mounting plate 54 so that the tie bar is out of the way of the die set 12 to facilitate removal of the bend die post 22, wiper die post 24 and the die set 12 from the bending machine 10 as a unit and replacement with an alternative bend die post, wiper die post and die set unit.

When the alternative bend die post, wiper die post and die set unit is installed, or the original bend die post, wiper die post and die set unit is re-installed, on the bending machine 10, it is not necessary to again set the tension again using the lock nut-washer combination 188 on the threaded end portion of the outward end 72 of the tie bar 50 as done during the initial set up procedure. Rather, once the bend die post, wiper die post and die set unit is attached to the bending machine, the pull pin 78 is inserted through the apertures 76 in the machine tooling bracket 62 and the elongated aperture 74 in the tie bar fitting 64, and the cam lever 184 is moved from its position in the cam lever rotation slot 136 at the end 196 toward the end 200 to return the tie bar tensioning system 58 to the tensioned configuration, and the tabbed locking pin 204 is inserted through the outer locking pin hole 132 and into the radial locking pin hole of the rotatable face cam. With this relatively simple and quick procedure, the bending machine 10 is ready for use with the installed bend die post, wiper die post and die set unit. Thus, once the lock nut-washer combination 188 of the tie bar tensioning system 58 has been initially set to the desired correct tension on initial assembly of the system, no further resetting is needed when the alternative or original bend die post, wiper die post and die set unit is installed on the bending machine 10. This also eliminates the need for spanners in normal operation.

Figure 5A:
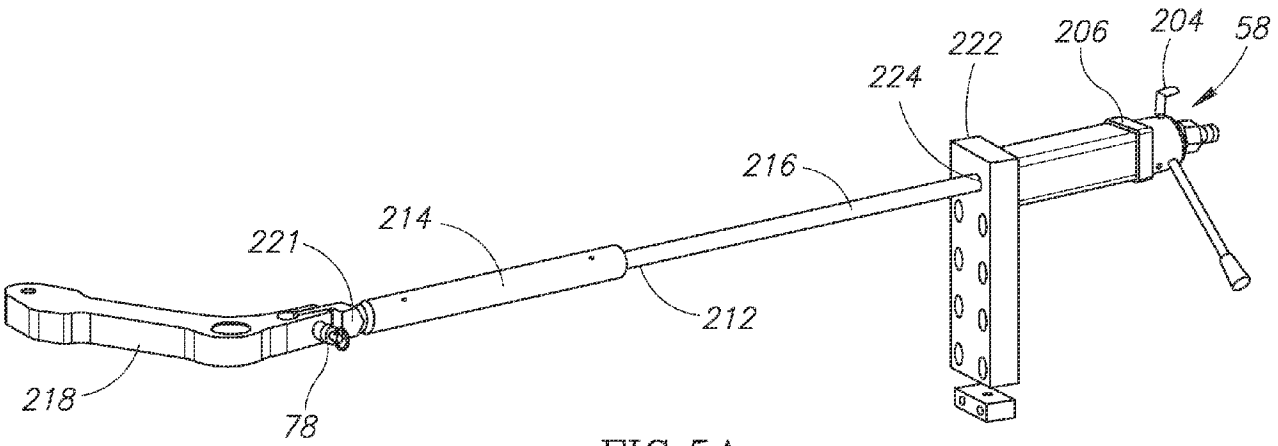
FIG. 5A is a perspective view of the tie bar of the second tie bar tensioning system of FIG. 1.
Figure 5B:
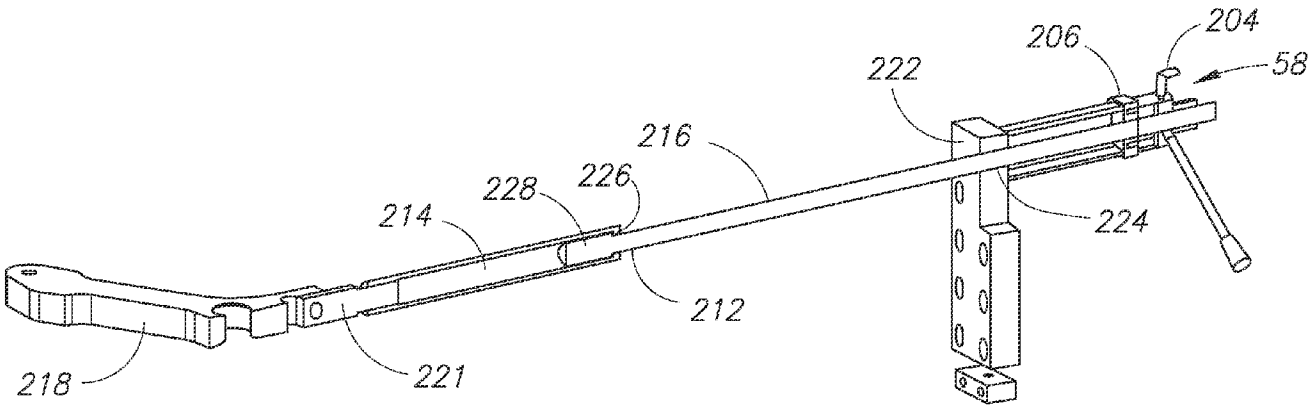
FIG. 5B is a partial cross-sectional view of the second tie bar tensioning system of FIG. 5A.

FIGS. 1, 5A and 5B show a second embodiment of the conceptual tie bar tensioning system 58 used to selectively apply and release tension to a second tie bar 212 coupled between the upper end of the bend die post 22 and a tie bar mounting plate 206 supported by a support frame 222 attached to the upper end of the stationary support arm 220. In some applications, there may not be sufficient room for the tie bar 212 to project out from the bending machine 10 through an aperture in the tie bar mounting plate 206, as occurs with tie bar 50 projecting out through the aperture in tie bar mounting plate 54 after it has been decoupled from the machine tooling bracket 62 as discussed above.

To accommodate these applications, the tie bar 212 is configured to be telescopically shortened after it is disconnected from the bend die post 22. The tie bar 212 includes an inward bar portion 214 and an outward bar portion 216. The tie bar 212 is removably joined to the upper end of the bend die post 22, at a position above the machine tooling bracket 62, by a machine tooling bracket 218 removably attached to a tie bar fitting 221 attached to the inward bar portion 214 of the tie bar, much as described above for tie bar 50. The inward bar portion 214 is telescopically and slideably mounted on the inward end of the outward bar portion 216 which is received inside the inward bar portion. As such, the inward bar portion 214 may be slid outward on the outward bar portion 216 and hence moved away from the machine tooling bracket 218 once the tie bar fitting 221 is disconnected from the machine tooling bracket to move the tie bar 212 sufficiently out of the way of the die set 12 to facilitate its removal from the bending machine 10 and replacement with an alternative die set.

The tie bar tensioning system 58 is mounted to an outward side of a support frame 222 with an aperture 224 through which the outward bar portion 216 of the tie bar 212 extends to apply and release to the tie bar. A circumferential, inwardly projecting stop shoulder 226 is provided at the outward end of the inward bar portion 214 to engage a corresponding stop member 228 provided at the inward end of the outward bar portion 216 to limit the extent of telescopic outward movement of the outward bar portion 216 relative to the inward bar portion 214 when tensioning the tie bar 212 using the tie bar tensioning system 58.

It should be appreciated that other methods may be used to provide a tie bar that can be selectively shortened. For example, in some embodiments, the tie bar may include one or more hinges that couple multiple sections together to facilitate selective shortening of the tie bar.

Accordingly, these and other embodiments of the conceptual tie bar tensioning system facilitate the ability to physically separate a tie bar from a die set to which it was attached without requiring a tool and without having to fully remove the tie bar from a bending machine, thus allowing die sets and machine tools to be selectively and quickly removed and installed onto the bending machine. This reduces the time required to change machine tooling sets and further improve operator ergonomics.

Figure 11A:
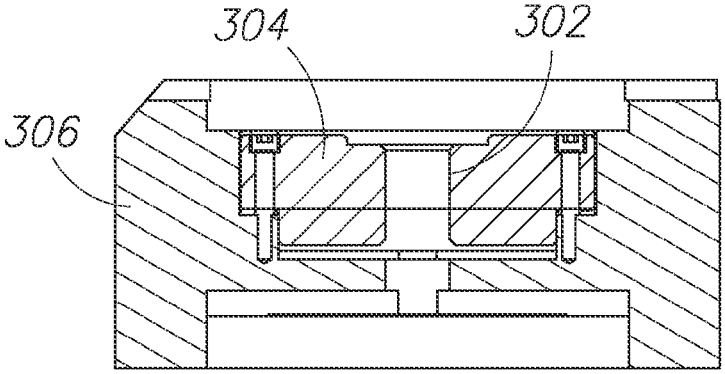
FIG. 11A is a cross-sectional view of a clamping device with a clamping socket for receiving the clamping pin of the bending die post of FIG. 10.
Figure 11B:
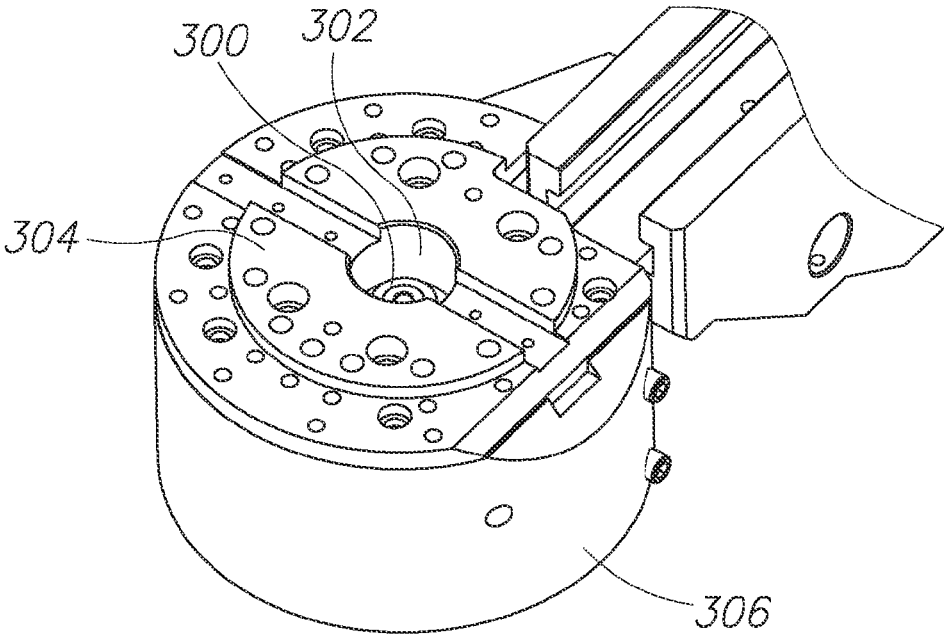
FIG. 11B is a perspective view of the clamping device of FIG. 11A.
Figure 11C:
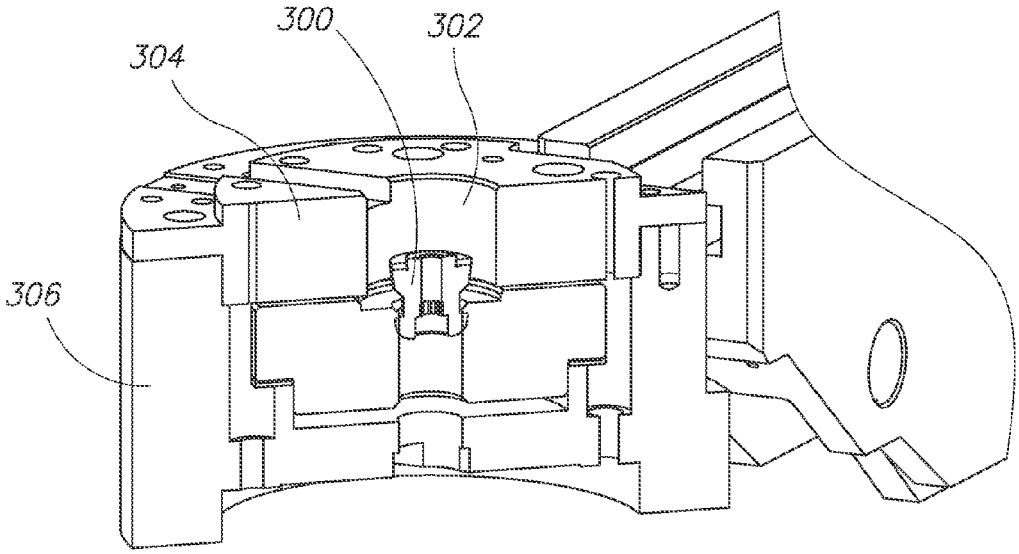
FIG. 11C is a partial cross-sectional, perspective view of the clamping device of FIG. 11B.
Figure 12A:
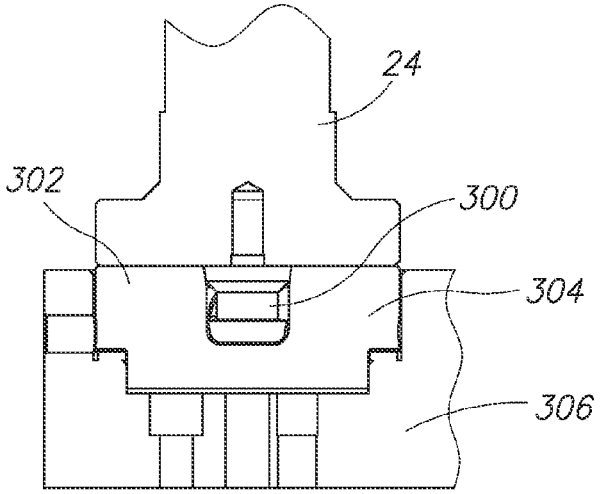
FIG. 12A is a cross-sectional view of a clamping device with a clamping socket for receiving the clamping pin of the wiper die post of FIG. 10.
Figure 12B:
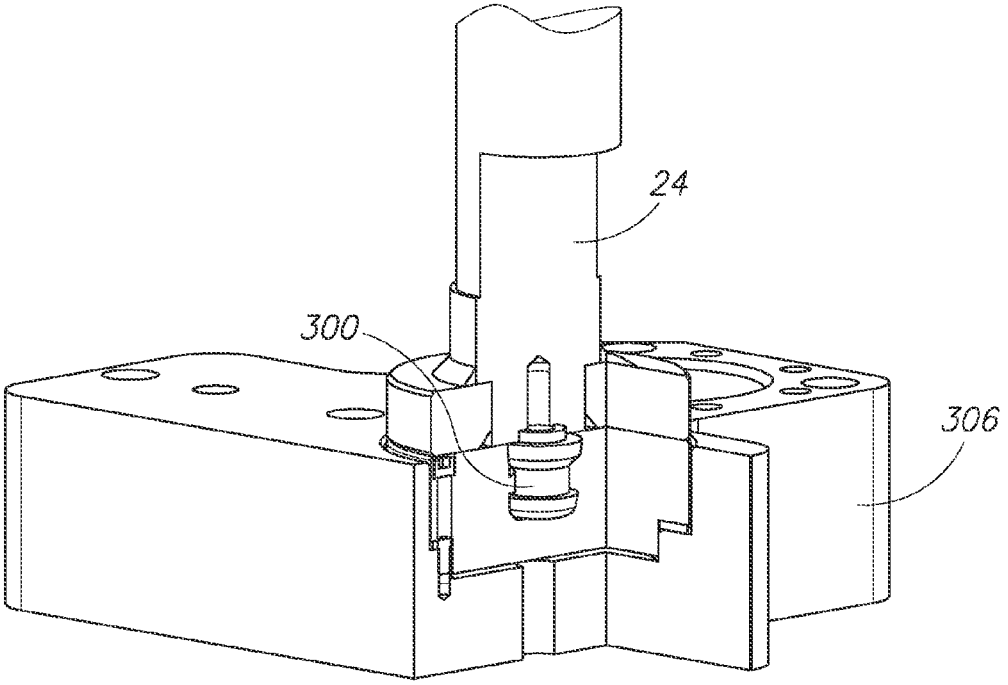
FIG. 12B is a partial cross-sectional, perspective view of the clamping device of FIG. 12A.

As shown in FIGS. 8-10 and 11B and 11C, the bottom of the bend die post 22 includes a clamping pin 300 (or "connecting prong") extending downward therefrom that is configured to selectively mate with a clamping socket 302 (see FIGS. 11A-C) of a clamping device 304 coupled to a bend arm 306 of the bending machine 10. The clamping device 304 is used to selectively and releasably lock down the bend die post 22 to the bending machine 10 during use. Similarly, the bottom of the wiper die post 24 also includes a clamping pin 300 configured to mate with a corresponding clamping socket 302 (see FIGS. 12A and 12B). In some embodiments, the clamping device 304 may comprise a VERO-S NSE plus 138 provided by SCHUNK Intec Inc. of Morrisville, N.C.

In some embodiments, the clamp die stack 16 and the follower die 18 are secured in place by gravity without using a clamping device 304. In other embodiments, a clamping device 304 may be provided for these components as well.

Figure 13:
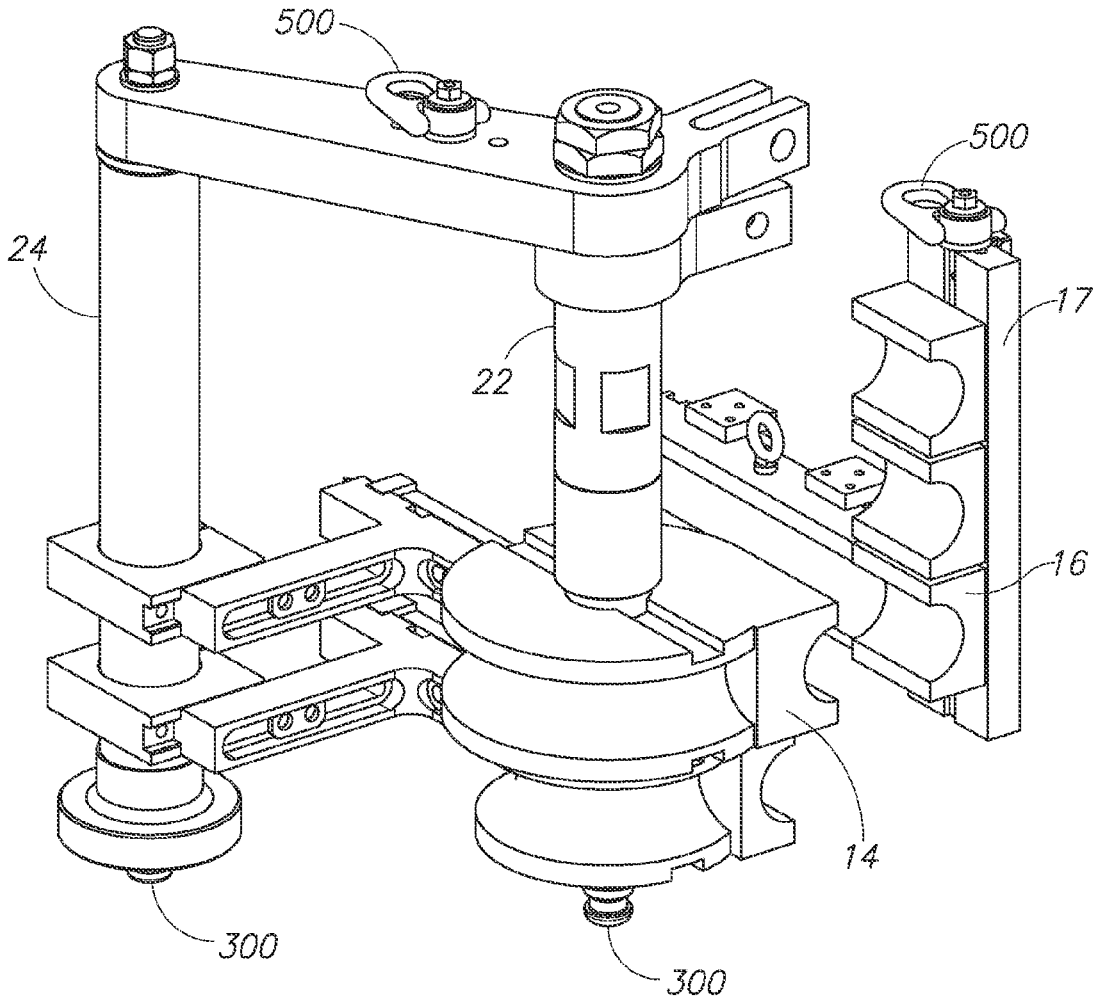
FIG. 13 is a perspective view of a die set according to an embodiment of the present invention that includes a bracket having an eye bolt.

FIG. 13 illustrates a die set 12 similar to the embodiment shown in FIGS. 6-12 except, in this embodiment, the clamp die bolster 17 and the lift plate 28 coupling the bend die post 22 and wiper die post 24 together are configured with lifting shackles 500, rather than eye bolts, to facilitate lifting by the hook 38 attached to the crane 40.

In these embodiments, a metal plate 502 (see FIG. 7) may be provided having multiple chains 504 hanging therefrom at different lengths with hooks (not shown for clarity) on their ends. For example, if there are three eye bolts 30, 32 and 36 (e.g., one on the lift plate 28 coupling the bend die post 22 and wiper die post 24, one on the clamp die bolster 17, and one on the follower die 18), there may be three chains 504 hanging down at different lengths from the plate 502. The plate 502 is coupled to a crane 40. The user could selectively choose which components to lift out by selecting to which eye bolts 30-36 (or lifting shackles 500) to couple to the hooks of the plate 502.

The conceptual tie bar tensioning system solves the problems associated with the prior art and allows a bending machine operator to removably couple an upper end of a bend die post to a tie bar, and further to selectively lock the tie bar in a tensioned position. Certain aspects of the conceptual tie bar tensioning system are broadly defined by a stationary member and a rotatable member. Both the stationary member and the rotatable member have respective tie bar passageways for slidably receiving the one end portion of a tie bar. Both the stationary member and the rotatable member also include respective engagement surfaces. When assembled, the rotatable member's engagement surface is rotatable relative to the stationary member's engagement surface between a released non-tensioned position and a tensioned position. The rotatable member is selectively lockable in the tensioned position. The rotation of the rotatable engagement surface relative to the stationary engagement surface in engagement with the stationary engagement surface longitudinally displaces the rotatable member relative to the stationary member. A sensor (not illustrated) may be added to prevent the bending machine 10 functioning unless the tie bar tensioning system 58 is appropriately in the locked tensioned configuration.

When the conceptual tie bar tensioning system is affixed to a bending machine such as to a tie bar mounting plate in the manner described above, a tie bar may then be positioned within the tie bar passageways of both the rotating and stationary members and a similar aperture in the tie bar mounting plate. An inward end of the tie bar may then be removably coupled to an upper end of a bend die post of the bending machine. The tie bar should be dimensioned such that, when its inward end is coupled to the bend die post, its opposing outward end is engaged with the rotatable member such that rotating the rotatable member from the released non-tensioned position to the tensioned position will cause the rotatable member to be displaced outwards relative to the stationary member, and place the tie bar under tension, thereby making a rigid connection between the pivot arm and the bend die post. The rotatable member can then be selectively locked in the tensioned position for operation of the bending machine.

If the operator wishes to remove, replace, or otherwise access the tooling on the bend die machine, it may be desirable to move the tie bar out of the way. Simply de-coupling the tie bar from the top of the bend die post while the bar is under tension is unadvisable. Instead, the rotatable member of the conceptual tie bar tensioning system can be rotated from the tensioned position to the released non-tensioned position, causing the rotatable member to be move inward relative to the stationary member, and hence relative to the bend die post of the bending machine, thereby removing the tension from the tie bar. The tie bar can then be safely de-coupled from the bend die post and moved out of the way of the tooling of the bending machine, for example by longitudinally sliding the tie bar outwardly from the bend die-post through the tie bar passage.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. For example, although the embodiments described above utilizes the opposing profiled surfaces of the stationery and rotatable engagement members to translate the rotatable face cam's rotation into liner displacement of the rotatable face cam within the sleeve, an alternative, unillustrated embodiment of the conceptual tie bar tensioning system may use cooperative threading, on an interior wall of the sleeve and the side wall of the rotatable member to accomplish the same result without departing from the scope of the inventive concept.

Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

The invention claimed is:

1. A tie bar tensioning system for selectively tensioning a tie bar removably couplable at a first end portion of the tie bar to an upper end portion of a bend die post of a bending machine and couplable at a second end portion of the tie bar to a tie bar mounting plate of the bending machine, the tie bar tensioning system comprising:

a stationary member having a stationary member tie bar passageway for receiving the second end portion of the tie bar and a stationary member engagement surface; and a rotatable member having a rotatable member tie bar passageway for receiving the second end portion of the tie bar and a rotatable member engagement surface, the rotatable member being selectively rotatable relative to the stationary member, the rotation of the rotatable member relative to the stationary member with the rotatable member engagement surface in engagement with the stationary member engagement surface longitudinally displacing the rotatable member relative to the stationary member between a tensioned position whereat tension is applied to the tie bar and a released position with less tension being applied to the tie bar, the rotatable member being selectively lockable in the tensioned position;

wherein the stationary member includes a sleeve portion extending outwardly from the stationary member tie bar passageway and defining an interior space dimensioned to receive the rotatable member at least partially therein, with the stationary member tie bar passageway and the rotatable member tie bar passageway in coaxial alignment.

2. The tie bar tensioning system of claim 1, wherein a side surface of the rotatable member includes a rotation lever opening and the sleeve portion of the stationary engagement member includes a rotation lever slot, and the tie bar tensioning system further includes a rotation lever having an end dimensioned to pass through the rotation lever slot of the sleeve and to be receivable in the rotation lever opening of the rotatable member for rotating the rotatable member relative to the stationary member.

3. The tie bar tensioning system of claim 2, wherein the rotation lever slot has a first end and an opposite second end, movement of the rotation lever in the rotation lever slot is restricted by the first and second ends, and the rotation lever being adjacent to the first end of the rotation lever slot corresponds to the rotatable member being in the released position and the rotation lever being adjacent to the second end of the rotation lever slot corresponds to the rotatable member being in the tensioned position.

4. The tie bar tensioning system of claim 1, wherein the rotatable member includes a lock pin opening and the sleeve portion includes a lock pin access opening, and the tie bar tensioning system further includes a lock pin having an end dimensioned to pass through the locking pin access opening of the sleeve and be received in the locking opening of the rotatable member to lock the rotatable member in the tensioned position by preventing rotation of the rotatable member relative to the stationary member.

5. The tie bar tensioning system of claim 1, wherein the rotatable member includes a rotation lever for rotating and longitudinally displacing the rotatable member relative to the stationary member.

6. The tie bar tensioning system of claim 1, wherein the rotatable member includes a lock pin opening and a lock pin removably receivable in the lock pin opening to selectively lock the rotatable member in the tensioned position when the lock pin is inserted into the lock pin opening by preventing rotation of the rotatable member relative to the stationary member.

7. A tie bar tensioning system for selectively coupling an upper end portion of a bend die post of a rotary draw bending machine to a tie bar mounting plate of the rotary draw bending machine, the tie bar tensioning system comprising:

a tie bar having a first end portion removably couplable to the upper end portion of the bend die post and a second end portion couplable to the tie bar mounting plate;

a stationary member having a stationary member tie bar passageway for receiving the second end portion of the tie bar and a stationary member engagement surface; and a rotatable member having a rotatable member tie bar passage for receiving the second end portion of the tie bar and a rotatable member engagement surface, the rotatable member being selectively rotatable relative to the stationary member, the rotation of the rotatable member relative to the stationary member with the rotatable member engagement surface in engagement with the stationary member engagement surface longitudinally displacing the rotatable member relative to the stationary member between a tensioned position whereat tension is applied to the tie bar and a released position with less tension being applied to the tie bar, the rotatable member being selectively lockable in the tensioned position;

wherein the stationary member includes a sleeve portion extending outwardly from the stationary member tie bar passageway and defining an interior space dimensioned to receive the rotatable member at least partially therein, with the stationary member tie bar passageway and the rotatable member tie bar passageway in coaxial alignment.

8. The tie bar tensioning system of claim 7, wherein a side surface of the rotatable member includes a rotation lever opening and the sleeve portion of the stationary engagement member includes a rotation lever slot, and the tie bar tensioning system further includes a rotation lever having an end dimensioned to pass through the rotation lever slot of the sleeve and to be receivable in the rotation lever opening of the rotatable member for rotating the rotatable member relative to the stationary member.

9. The tie bar tensioning system of claim 8, wherein the rotation lever slot has a first end and an opposite second end, movement of the rotation lever in the rotation lever slot is restricted by the first and second ends, and the rotation lever being adjacent to the first end of the rotation lever slot corresponds to the rotatable member being in the released position and the rotation lever being adjacent to the second end of the rotation lever slot corresponds to the rotatable member being in the tensioned position.

10. The tie bar tensioning system of claim 7, wherein the rotatable member includes a lock pin opening and the sleeve portion includes a lock pin access opening, and the tie bar tensioning system further includes a lock pin having an end dimensioned to pass through the locking pin access opening of the sleeve and be received in the locking opening of the rotatable member to lock the rotatable member in the tensioned position by preventing rotation of the rotatable member relative to the stationary member.

11. The tie bar tensioning system of claim 7, wherein the rotatable member includes a rotation lever for rotating and longitudinally displacing the rotatable member relative to the stationary member.

12. The tie bar tensioning system of claim 7, wherein the rotatable member includes a lock pin opening and a lock pin removably receivable in the lock pin opening to selectively lock the rotatable member in the tensioned position when the lock pin is inserted into the lock pin opening by preventing rotation of the rotatable member relative to the stationary member.

13. The tie bar tensioning system of claim 7, wherein the tie bar has an inward end with a pull-pin aperture, and the tie bar tensioning system further includes a bracket attachable to upper end portion of the bend die post of the bending machine and having a pull-pin aperture, and a pull pin dimensioned to pass through the pull-pin aperture of the tie bar and the pull-pin aperture of the bracket to removably coupling the inward end of the tie bar to the bracket attached to the bend die post.

14. The tie bar tensioning system of claim 7, further including a bracket attachable to upper end portion of the bend die post of the bending machine and having a connection portion, the first end portion of the tie bar being selectively connectable with the connection portion of the bracket to allow releasable coupling of the first end portion of the tie bar to the bracket when attached to the bend die post.

15. The tie bar tensioning system of claim 7, wherein the first end portion of the tie bar is outwardly movable relative to the second end portion of the tie bar.

16. The tie bar tensioning system of claim 15, wherein the first end portion of the tie bar and the second end portion of the tie bar are configured with one telescopically disposed within the other.

17. The tie bar tensioning system of claim 7, wherein when the first end portion of the tie bar is decoupled from the upper end portion of the bend die post, the tie bar is axially movable away from the bend die post through the stationary member and rotatable member tie bar passageways.

18. The tie bar tensioning system of claim 7, wherein the rotatable member has an outwardly facing tensioning surface and the tie bar has an inwardly facing tensioning surface at the second end portion of the tie bar for engaging the outwardly facing tensioning surface of the rotatable member.

19. A bending machine comprising:

a stationary base;

a bend die post extending upwardly from the stationary base and having an upper end portion;

a support arm spaced away from the bend die post;

a tie bar mounting plate attached to the support arm and having a tie bar aperture;

a bracket attached to an upper end portion of the bend die post;

a tie bar having a first end portion couplable to the bracket and a second end portion extending through the tie bar aperture of the tie bar mounting plate;

a stationary member attached to the tie bar mounting plate and having a stationary member tie bar passageway in alignment with the tie bar aperture of the tie bar mounting plate and having the second end portion of the tie bar extending through the stationary member tie bar passageway, the stationary member having a stationary member engagement surface; and a rotatable member having a rotatable member tie bar passageway in alignment with the stationary member tie bar passageway and having the second end portion of the tie bar extending through the rotatable member tie bar passageway, the rotatable member having a rotatable member engagement surface, the rotatable member being selectively rotatable relative to the stationary member, the rotation of the rotatable member relative to the stationary member with the rotatable member engagement surface in engagement with the stationary member engagement surface longitudinally displacing the rotatable member relative to the stationary member between a tensioned position whereat tension is applied to the tie bar and a released position with less tension being applied to the tie bar;

wherein the stationary member includes a sleeve portion extending outwardly from the stationary member tie bar passageway and defining an interior space dimensioned to receive the rotatable member at least partially therein with the stationary member tie bar passageway and the rotatable member tie bar passageway in coaxial alignment.

20. The bending machine of claim 19, wherein the rotatable member is selectively lockable in the tensioned position.

21. The bending machine of claim 19, wherein the first end portion of the tie bar is outwardly movable relative to the second end portion of the tie bar.

22. The bending machine of claim 19, wherein the first end portion of the tie bar and the second end portion of the tie bar are configured with one telescopically disposed within the other.

23. The bending machine of claim 19, wherein when the first end portion of the tie bar is decoupled from the bracket the tie bar is axially movable away from the bracket through the stationary member and rotatable member tie bar passageways.

24. The bending machine of claim 19, wherein the bend die post has a lower end portion with a downwardly extending clamping pin, and the stationary base has a clamping socket to releasably lock the clamping pin therein.

25. The bending machine of claim 19, further including a wiper die post extending upwardly from the stationary base and having an upper end portion, and a plate extending between and coupled to the upper end portion of the bend die post and the upper portion of the wiper die post, and wherein the bend die post has a lower end portion with a downwardly extending clamping pin, and the stationary base has a clamping socket to releasably lock the clamping pin of the bend die post therein, and the wiper die post has a lower end portion with a downwardly extending clamping pin, and the stationary base has a clamping socket to releasably lock the clamping pin of the wiper die post therein, whereas as the bend die post and the wiper die post can be lifted simultaneously by an upward lifting force applied to the plate upon release of the clamping pins of the bend die post and the wiper die post from the clamping sockets within which releasably positioned.

* * * * *